US007503298B2

(12) United States Patent
Kinugawa et al.

(10) Patent No.: US 7,503,298 B2
(45) Date of Patent: Mar. 17, 2009

(54) VALVE TIMING ADJUSTING DEVICE

(75) Inventors: Hiroyuki Kinugawa, Tokyo (JP); Akira Sakata, Tokyo (JP); Koji Yudate, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 134 days.

(21) Appl. No.: 10/577,021

(22) PCT Filed: May 17, 2005

(86) PCT No.: PCT/JP2005/008986

§ 371 (c)(1),
(2), (4) Date: Apr. 25, 2006

(87) PCT Pub. No.: WO2006/022056

PCT Pub. Date: Mar. 2, 2006

(65) Prior Publication Data

US 2007/0074691 A1 Apr. 5, 2007

(30) Foreign Application Priority Data

Aug. 27, 2004 (JP) ..... 2004-248900

(51) Int. Cl.
*F01L 1/34* (2006.01)

(52) U.S. Cl. ..... 123/90.17; 123/90.15; 123/90.16; 92/5 L

(58) Field of Classification Search ..... 123/90.17; 92/5 L

See application file for complete search history.

(56) References Cited

U.S. PATENT DOCUMENTS

| | | | | |
|---|---|---|---|---|
| 4,483,366 | A * | 11/1984 | Labita | 137/385 |
| 6,520,132 | B2 * | 2/2003 | Todo | 123/90.17 |
| 6,742,485 | B2 * | 6/2004 | Lichti | 123/90.17 |
| 6,962,133 | B2 * | 11/2005 | Ogawa | 123/90.17 |

FOREIGN PATENT DOCUMENTS

| | | | |
|---|---|---|---|
| JP | 2001-50016 | A | 2/2001 |
| JP | 2001-227311 | A | 8/2001 |
| JP | 2002-4816 | A | 1/2002 |
| JP | 2003-20963 | A | 1/2003 |
| JP | 2003-328708 | A | 11/2003 |

* cited by examiner

*Primary Examiner*—Thomas E Denion
*Assistant Examiner*—Kyle M Riddle
(74) *Attorney, Agent, or Firm*—Birch, Stewart, Kolasch & Birch, LLP

(57) ABSTRACT

A valve timing adjusting device includes: a first rotor rotating integrally with a crankshaft; a second rotor integrally secured to an intake or exhaust camshaft; and an engaging cavity provided in one of the first rotor and the second rotor. A lock pin is housed in a housing hole provided in the other of the first rotor and the second rotor, protruded by the energizing force of an energizing device at the time of hydraulic pressure reduction, to thus abut on the wall of the engaging cavity from an oblique direction to give a relative rotating force to the first rotor and the second rotor.

4 Claims, 5 Drawing Sheets

(a)

(b)

VALVE TIMING ADJUSTING DEVICE

TECHNICAL FIELD

The present invention relates to a valve timing adjusting device that controls opening and closing timings of the intake valve or exhaust valve of an internal combustion engine such as engine (hereinafter referred to as engine).

BACKGROUND ART

A conventional valve timing adjusting device includes: a first rotor that integrally fixes the following three parts, a housing having the bearing of a camshaft, a case internally having a plurality of shoes projecting therefrom and having hydraulic chambers formed between the shoes, and a cover covering the hydraulic chambers, and that rotates integrally with a crankshaft; and a second rotor that has a plurality of vanes each dividing each of the hydraulic chambers into an advanced-angle hydraulic chamber and a retarded-angle hydraulic chamber, can relatively rotate through a predetermined angle within the first rotor, and is integrally fixed with an intake or exhaust camshaft, wherein the hydraulic pressure of an oil pump for supplying oil to the sliding portion of an engine is supplied and discharged, and this hydraulic pressure controls the relative position of the second rotor with respect to the first rotor.

In the constitution described above, when there exits no hydraulic power used at the time of engine start-up, the shoe of the first rotor and the vane of the second rotor repeat to abut on and separate from each other to cause slapping sounds. For this reason, one of the first rotor and the second rotor is provided with an engaging cavity, and the other thereof is provided with a lock pin engaging in and disengaging from the engaging cavity; and when there is no hydraulic pressure power used at the time of engine start-up, the lock pin is caused to engage in the engaging cavity by an energizing member, thus fixing the relative position between the first rotor and the second rotor to prevent the occurrence of the slapping sounds. In addition, this lock pin travels to the releasing direction by means of hydraulic power resisting the energizing force of the energizing member. During this traveling, the back pressure existing at the rear of the lock pin is discharged outside.

In this case, a minute or micro clearance is provided between the lock pin and the engaging cavity so that the cylindrical lock pin smoothly engages in the engaging cavity, and the first rotor and the second rotor can relatively rotate through a minute angle even in a lock-pin engaging state. Consequently, this minute-angle-relative rotation causes slapping sounds, and further, causes angular misalignments when the device is assembled to the engine. This is a problem when high-precise assembly is demanded.

For this reason, in order to prevent this minute rotation, the lock pin and the engaging cavity are given the shape of a taper, and thereby, these parts are caused to interengage without a clearance, as disclosed by JP-A-2002-004816 and JP-A-2003-328708.

Patent Reference 1: JP-A-2002-004816

Patent Reference 2: JP-A-2003-328708

The conventional valve timing adjusting device is arranged as mentioned above, thus requiring fine manufacturing tolerances or precision and the high cost of production to give the tapered shape to the lock pin and the engaging cavity. Moreover, there is a problem that the lock pin is accidentally released from the engaging cavity by the component force of the alternative force of the cam to produce slapping sounds.

The present invention has been accomplished to solve the above-mentioned problem. An object of the present invention is to provide a valve timing adjusting device capable of suppressing the accidental release of the lock pin from the engaging cavity by a simple configuration and further preventing the occurrence of slapping sounds.

DISCLOSURE OF THE INVENTION

The valve timing adjusting device according to the present invention includes: a first rotor rotating integrally with a crankshaft; a second rotor integrally fixed with an intake or exhaust camshaft; and an engaging cavity provided in one of the first rotor and the second rotor, wherein the lock pin is housed in a housing hole provided in the other of the first rotor and the second rotor, and projected therefrom by the energizing force of an energizing means when the hydraulic pressure is reduced, thereby abutting on the wall of the engaging cavity from an oblique direction to give a relative rotating force to the first rotor and the second rotor.

In this way, it is arranged that the lock pin is in contact with the wall of the engaging cavity from an oblique direction, thereby giving a relative rotating force to the first rotor and the second rotor with this abutting force. Accordingly, one of the first rotor and the second rotor rotates such that the engagement between the lock pin and the engaging cavity increases, and the rotor brings about the engagement between the shoe and the vane of both the rotors to reduce the clearance to zero. As a result, the effects that the lock pin is not accidentally released from the engaging cavity and that the slapping sound is not caused are obtained.

BEST MODE FOR CARRYING OUT THE INVENTION

An embodiment of the present invention will now be described by reference to the drawings in order to make description in further detail of the present invention.

Embodiment 1

Figure 1:
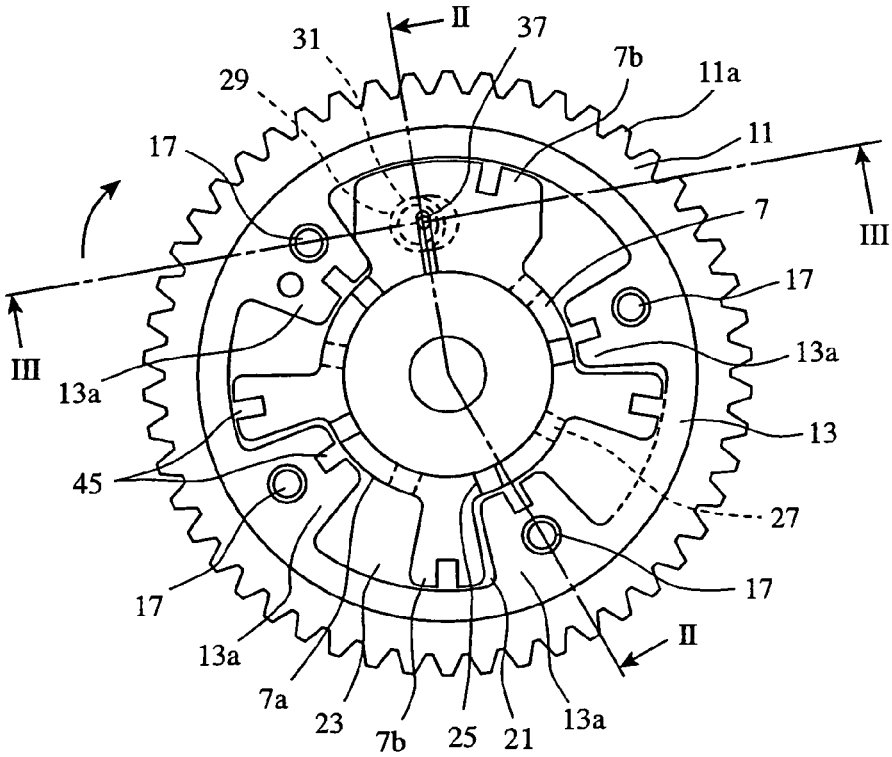
FIG. 1 is a view of the internal configuration of a valve timing adjusting device in accordance with Embodiment 1 of the present invention, and is a longitudinal sectional view thereof taken along the line I-I of FIG. 2, later described.
Figure 2:
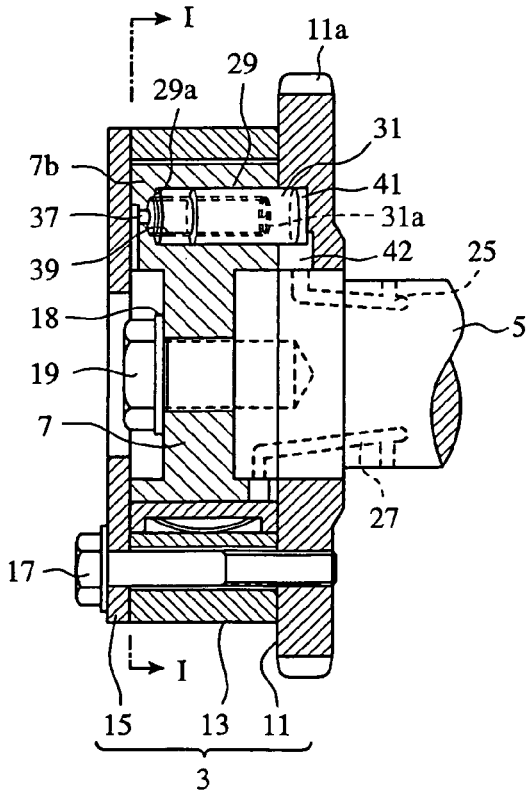
FIG. 2 is a traverse sectional view of the state where a vane rotor is placed at the most retarded angle position with respect to a first rotor, taken along the line II-II of FIG. 1.

The drawings are views of the internal configuration of a valve timing adjusting device in accordance with Embodiment 1 of the present invention; FIG. 1 is a traverse sectional view thereof taken along the I-I line in FIG. 2, described later; FIG. 2 is a longitudinal sectional view thereof taken along the line II-II line of FIG. 1; and FIG. 3 is a partially enlarged view thereof taken along the line III-III of FIG. 1.

Figure 3:
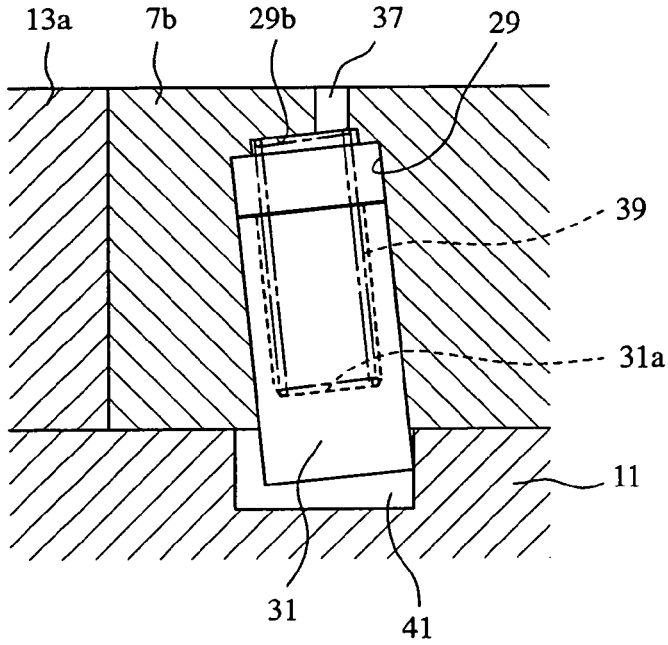
FIG. 3(*a*) and FIG. 3(*b*) are enlarged longitudinal sectional views thereof taken along the line III-III of FIG. 1.
Figure 3:
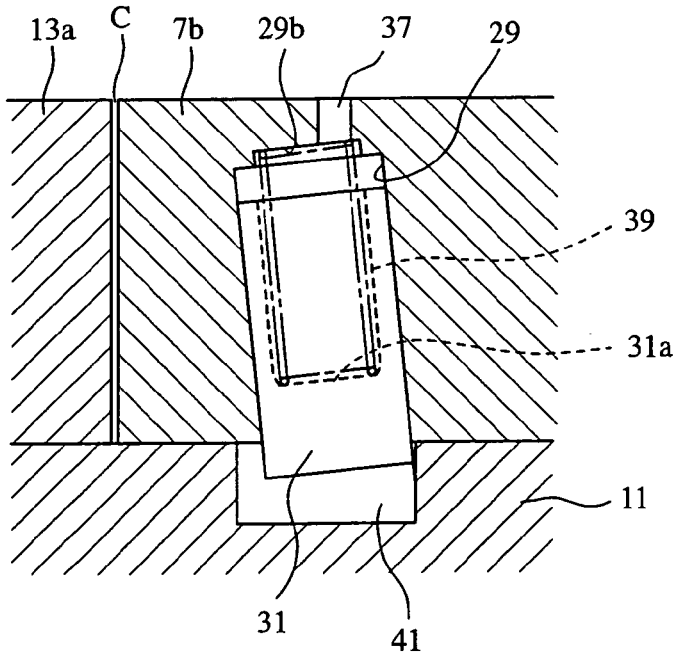

The valve timing adjusting device 1 in accordance with Embodiment 1 is generally composed of, as shown in FIG. 1 to FIG. 3, a first rotor 3 that rotates synchronizingly with the crankshaft (not shown) of an engine (not shown) through a chain (not shown); and a second rotor 7 that is disposed within this first rotor 3, and is integrally secured on the end face of an intake or exhaust camshaft (hereinafter referred to as camshaft) 5.

The first rotor 3 is generally composed of a housing 11 that externally has a sprocket 11*a* receiving the rotational driving force of the crankshaft (not shown), and that internally has a bearing (not shown) slidingly contacting the outer peripheral surface located in the vicinity of the end face of the camshaft 5; a case 13 that is disposed adjacently to this housing 11, and that internally has a plurality of shoes 13*a* (four shoes as shown in FIG. 1), which radially inwardly project therefrom to form a plurality of spaces; and a cover 15 that covers the internal space of this case 13, wherein these three parts are integrally fastened to each other with a bolt 17.

The second rotor 7 is a rotor having: a boss 7*a* integrally fastened on the end face of the camshaft 5, which rotates in the direction of the arrow, with a bolt 19 through a washer 18; and a plurality of vanes 7*b* radially outwardly projecting from the periphery of this boss 7*a* (hereinafter the second rotor 7 is referred to as vane rotor 7). Each of the vanes 7*b* of the vane rotor 7 partitions each of a plurality of internal spaces formed by the shoes 13*a* of the case 13 into an advanced-angle hydraulic chamber 21 that receives the supply of the hydraulic pressure when the vane rotor 7 is relatively rotated to the advanced angle side with respect to the first rotor 3 and an retarded-angle hydraulic chamber 23 that receives the supply of the hydraulic pressure when the vane rotor 7 is relatively rotated to the retarded angle side with respect to the first rotor 3. One end of a first oil passage 25 formed in the interior of the camshaft 5 is connected to each advanced-angle hydraulic chamber 21, while one end of the second oil passage 27 similarly formed in the interior of the camshaft 5 is connected to each retarded-angle hydraulic chamber 23. Each other end of the first oil passage 25 and the second oil passage 27 leads to an oil pump (not shown) and an oil pan (not shown) through an oil-controlling valve (not shown, and hereinafter referred to as OCV).

Further, a lock-pin housing hole 29 having a bottom 29*a* on the side opposite to the housing 11 in an axial direction thereof is formed in one vane 7*b* of the vane rotor 7 provided in this valve timing adjusting device 1. The bottom 29*a* of this lock-pin housing hole 29 is provided with a back-pressure exhausting hole 37 communicating the space existing within the housing hole 29 to the atmosphere. Furthermore, a coil spring (energizing means) 39 for always axially energizing the lock pin 31 is disposed between the bottom 29*a* of the lock-pin housing hole 29 and the bottom 31*a* of the lock pin 31.

Meanwhile, an engaging cavity 41 is formed on the housing side such that the lock pin 31 is advanced in the axial direction to be engaged by the energizing force of the coil spring 39 when the relative position of the vane rotor 7 with respect to the case 13 is placed at the most retarded angle position (initial position). In addition, a lock-releasing oil passage 42 serving as a third oil passage is provided between this engaging cavity 41 and the first oil passage 25.

Additionally, a minute clearance between the outermost periphery of the vane 7*b* of the vane rotor 7 and the innermost periphery of the shoe 13*a* of the case 13 can be maintained in order to prevent the flow of oil between the advanced-angle hydraulic chamber 21 and the retarded-angle hydraulic chamber; however, the shown example is provided with a seal means 45 consisting of a seal member and an energizing member.

The operation will now be described as below.

Upon stopping of the engine, the oil remaining in the advanced-angle hydraulic chamber 21 and the retarded-angle hydraulic chamber 23 of the valve timing adjusting device 1 is returned to the oil pan (not shown) via the first oil passage 25, the second oil passage 27, and the OCV (not shown); for this reason, the lock pin 31 is engaged in the engaging hole 41 by the energizing force of the coil spring 39, and is restricted in the initial position where the relative rotation between the first rotor 3 and the vane rotor 7 exists in the most retarded angle position. At that time, because the lock pin abuts on the wall of the engaging cavity from an oblique direction, the lock pin gives a relative rotating force to the first rotor and the vane rotor by the energizing force of the coil spring 39 serving as the energizing means. As a result, in the first stage where the lock pin abutted on the wall of the engaging cavity, there exists a clearance C between the first rotor and the vane rotor as shown in FIG. 3(*b*); however, when the lock pin sufficiently engaged in the engaging cavity as shown in FIG. 3(*a*), the clearance C disappears by the relative rotation between the first rotor and the vane rotor, thereby integrating the two rotors.

Then, when the oil pump (not shown) is driven by starting the engine, the oil is supplied from the oil pan (not shown) to the advanced-angle hydraulic chamber 21 of the valve timing adjusting device 1 through the OCV (not shown) and the first oil passage 25. When the advanced-angle hydraulic pressure worked on the tip of the lock pin 31 from the first oil passage 25 through the lock-releasing oil passage 42, the lock pin 31 is thrust back against the energizing force of the coil spring 39, and slips out from the engaging hole 41. At that time, the first rotor 3 and the vane rotor 7 can relatively rotate (lock-releasing state).

The first rotor 3 and vane rotor 7 existing in the lock-releasing state are allowed to relatively travel to the advance-angle side through a predetermined rotation angle by the advanced-angle hydraulic pressure supplied to the advanced-angle hydraulic chamber 21 at that time.

As described above, according to Embodiment 1, it is arranged that the lock pin abuts on the wall of the engaging cavity from an oblique direction to thus give a relative rotating force to the first rotor and the vane rotor with the abutting force; accordingly, the lock pin begins abutting on the wall of the engaging cavity prior to the time when the vane rotor assumes the most retarded angle position. At the start of this abutment, the lock pin engages therein only in the tip portion thereof, and in this state, the advanced-angle travel of the vane rotor can be restricted; however, the rotor is free to rotate in the retarded-angle direction through a minute angle.

When the vane rotor rotates from this state in the retard-angle direction, the amount of projection of the lock pin 31 from the housing hole 29 increases, and the wall of the engaging cavity and the lock pin engage each other at the back portion of this engaging cavity 41, thus reducing the angle through which the vane rotor can rotate in the retard-angle direction. Further, when the vane rotor finally assumed the most retarded angle position, the shoe 13*a* of the first rotor and the vane 7*b* of the vane rotor abut on each other. This does not allow the vane rotor to further rotate in the retard-angle direction, and the lock pin 31 projecting from the housing hole 29 and the wall of the engaging cavity 41 abuts on each other, thus also restricting the rotation thereof in the advance-angle direction. As a result, the angular misalignment caused by the clearance between the lock pin 31 and the housing hole 29 can be eliminated, and thereby the slapping sound is not caused.

The housing hole 29 is provided thereon such that the lock pin 31 housed therein abuts on the wall of the engaging cavity 41 from an oblique direction, and when a force in the advance-angle direction is applied to the vane rotor 7, a component force works on the lock pin 31 in the direction where the lock pin is released. However, the inclination of the housing hole 29 is gentle, and this inclination presses the lock pin 31 against the inner wall of the housing hole, thus not causing the component force alone to accidentally release the lock pin 31 from the engaging cavity 41, but enabling only the hydraulic supplied by the third oil passages 42 to release the lock pin 31 therefrom. As a result, because of the fact that the housing hole 29, the engaging cavity 41, and the lock pin 31 all do not have a taper, the structure of lock pin, which is simple, fabricable, and highly reliable, can be obtained.

Moreover, even if the housing hole 29 and the engaging cavity 41 are misaligned, only the depth of engagement of the lock pin 31 changes, but the reliability of engagement of the lock pin 31 does not change, thus enabling the positional tolerance of the engaging cavity 41 to be rough. In addition, by giving the shape of a groove to the engaging cavity 41, the positional tolerance of the engaging cavity 41 can be lowered.

Embodiment 2

Figure 4:
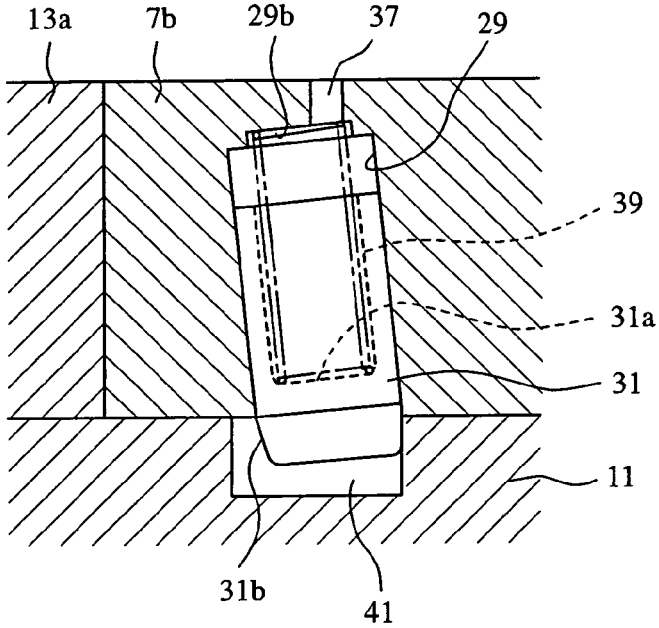
FIG. 4 is a longitudinal sectional view of an important part of a valve timing adjusting device in accordance with Embodiment 2 of the present invention.

In Embodiment 1, the housing hole 29 is inclined to the axis of the engaging cavity 41, and the tip of the lock pin 31 projecting from the housing hole 29 abuts on the wall of the engaging cavity with the ridge of the one side of the tip linearly abutting thereon. Hence, in Embodiment 2, as shown in FIG. 4, the side 31*b* of the tip of the lock pin, opposed to the wall of the engaging cavity 41, is given the shape of a taper such that the side is parallel to the wall of the engaging cavity, thus enabling the tip of the lock pin to come in face-to-face contact with the wall of the engaging cavity 41 with this taper. Hereby, the reliability of the engagement between the tip of the lock pin and the wall of the engaging cavity 41 improves. In addition, even if an advance-angle force acts on the vane rotor existing in the state of engagement, no component force works thereon in the direction of lock-pin release, thereby further improving the reliability thereof.

Embodiment 3

Figure 5:
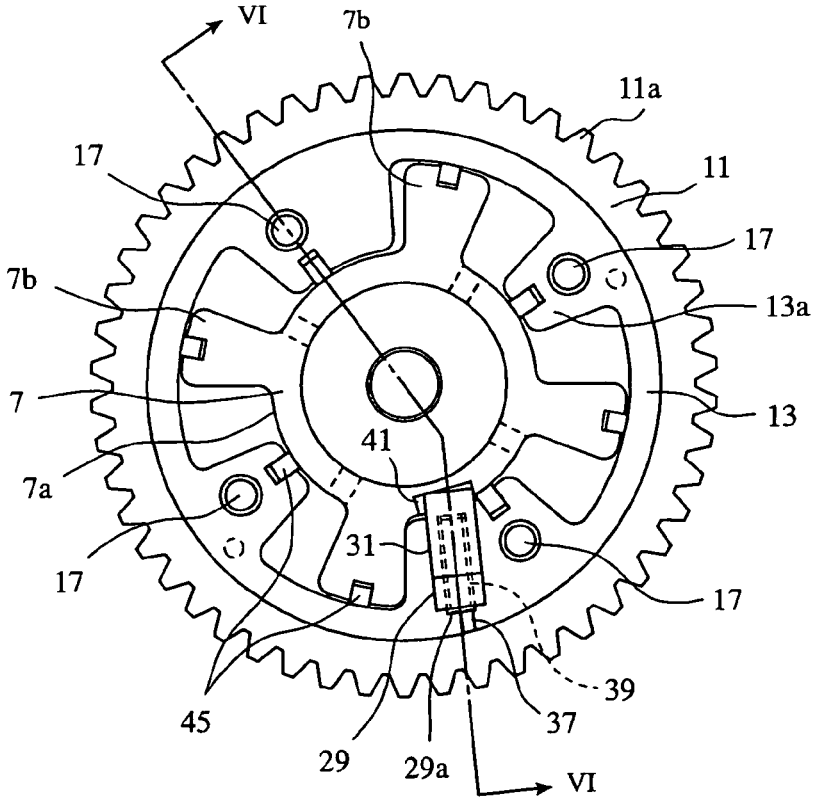
FIG. 5 is a view of the internal configuration of a valve timing adjusting device in accordance with Embodiment 3 of the present invention, and is a longitudinal sectional view thereof taken along the line V-V of FIG. 6, later described.
Figure 6:
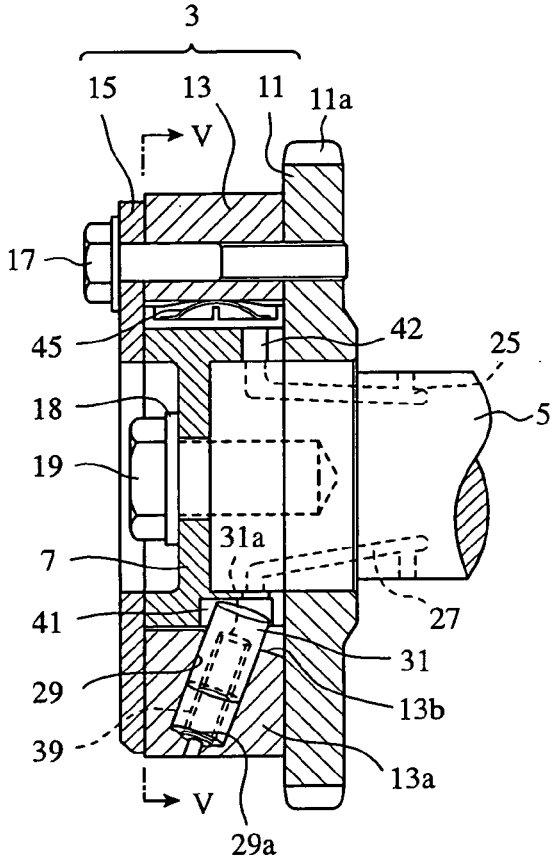
FIG. 6 is a traverse sectional view thereof taken along the line VI-VI line of FIG. 5.

In Embodiments 1 and 2, the housing hole 29 of the lock pin 31 is provided in the vane 7*b* of the vane rotor 7, and the engaging cavity 41 of the lock pin 31 is provided in the housing 11 of the first rotor 3; however, in Embodiment 3, as shown in FIG. 5 and FIG. 6, the housing hole 29 of the lock pin 31 is provided in the shoe 13*a* of the first rotor 3, the engaging cavity 41 of the lock pin 31 is provided in the outer peripheral surface of the boss 7*a* of the vane rotor 7. FIG. 5 is a traverse sectional view thereof taken along the V-V line in FIG. 6, described later, and FIG. 6 is a longitudinal sectional view thereof taken along the line VI-VI line of FIG. 5.

The housing hole 29 of the lock pin 31 in Embodiment 3 is formed inclining toward the end face of the first rotor 3 within the shoe 13*a* of this first rotor 3 such that the tip of the lock pin 31 abuts on the wall of the engaging cavity 41 from an oblique direction to give a relative rotating force to the first rotor and the vane rotor. In this respect, Embodiment 3 is different from Embodiments 1 and 2; however, the operation and the effect of thereof are the same as that of Embodiments 1 and 2 described above. Additionally, in Embodiment 3, machining the housing hole 29 can be carried out from the inner side of the shoe 13*a* of the first rotor 3, and the bottom of the hole can serve as the bottom 29*a* thereof, thus eliminating the need for an engaging member, which is interposed between the bottom 29*a* of the housing hole and the bottom 31*a* of the lock pin 31 and is used for preventing the disengagement of the energizing member 39 for energizing the lock pin 31 in the direction of protrusion.

Embodiment 4

Figure 7:
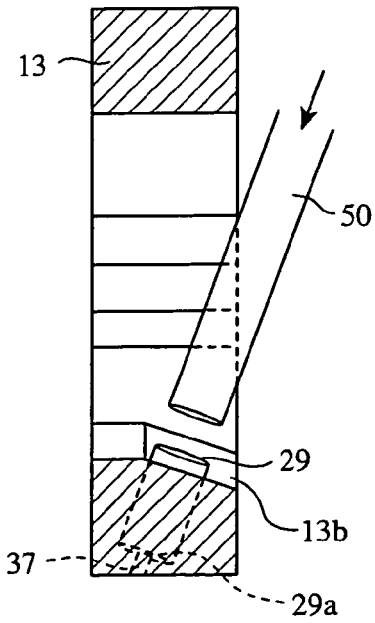
FIG. 7 is a schematic diagram of the state where a lock-pin-housing hole is machined in the shoe of a first rotor in accordance with Embodiment 4 of the present invention.

In Embodiment 3, the housing hole 29 of the lock pin 31 is formed inclined toward the end face of the first rotor 3 within the shoe 13*a* of this first rotor. Therefore, the tip of a tool 50 is caused to abut inclined on the end face of the shoe thereof, and then machining the housing hole is performed. Hence, the possibility arises that the tip of the tool 50 slips on the end face of the shoe, and the tip is misaligned relative to the position at which the work is to be done, thus making difficult the high-precision work. For this reason, in Embodiment 4, as shown in FIG. 7, the end face of the shoe to be machined for forming the housing hole 29 of the lock pin 31 is notched in a direction to intersect the direction of working of the tool 50, thereby forming a work-guide surface 13*b* thereon.

According to the arrangements of Embodiment 4, because the tool 50 is caused to move forward from a direction intersecting the work-guide surface 13*b* on the shoe 13*a* of the first rotor 3, the tool 50 does not slip on the work-guide surface 13*b* of the shoe 13*a* of the first rotor 3, and thereby, the housing hole 29 of the lock pin 31 can be precisely formed at a predetermined position.

Embodiment 5

Figure 8:
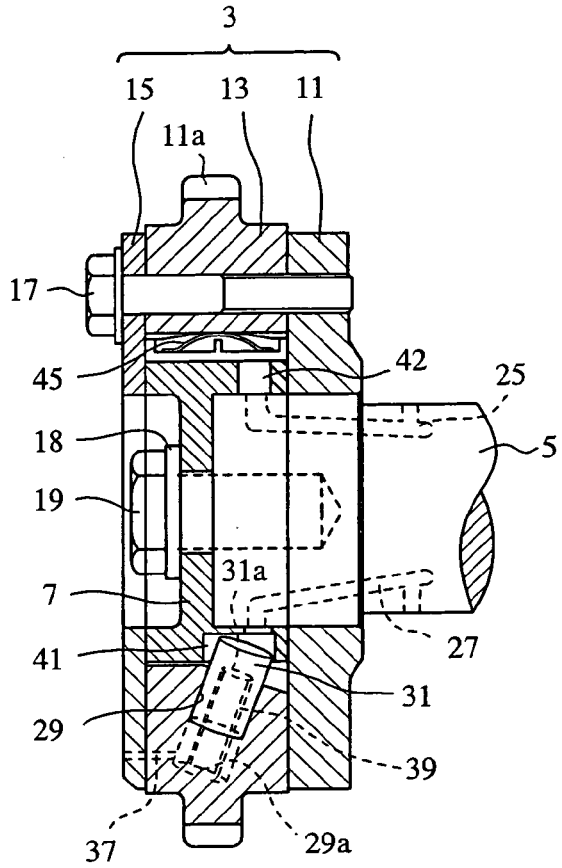
FIG. 8 is a longitudinal sectional view of the internal configuration of a valve timing adjusting device in accordance with Embodiment 5 of the present invention.

In Embodiments 1 to 4, the sprocket 11*a* is integrally provided around the outer peripheral surface of the housing 11; however, in this Embodiment 5, as shown in FIG. 8, the sprocket 11*a* is provided around the outer peripheral surface of the case 13. Thus the thickness of the first rotor 3 can be reduced to reduce the weight thereof, thereby enabling the well-balanced transmission of power from the crankshaft to the first rotor 3.

Embodiment 6

Figure 9:
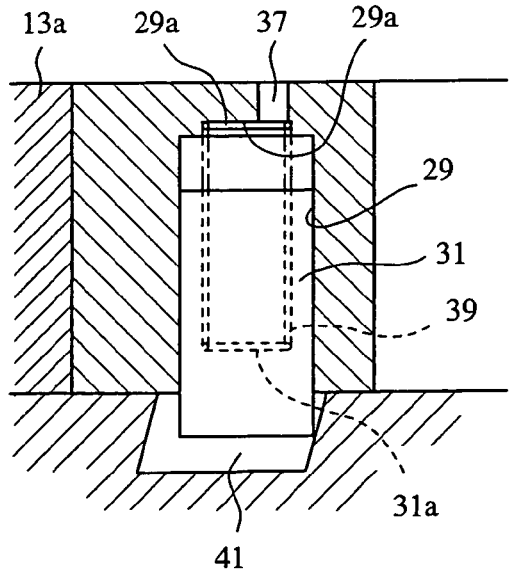
FIG. 9 is a longitudinal sectional view illustrating the relation between a lock pin and an engaging cavity in accordance with Embodiment 5 of the present invention.

In Embodiments 1 to 5, it is arranged that the lock pin 31 be caused to abut on the wall of the engaging cavity 41 from an oblique direction by disposing the housing hole 29 of the lock pin at an angle with the wall of the engaging cavity. However, as shown in FIG. 9, the housing hole 29 of the lock pin is formed in parallel to the rotation axis, and the engaging cavity 41 is formed such that the wall of the engaging cavity diagonally abuts on the tip of the lock pin 31 in regard to the lock pin 31 going in and out of this housing hole 29. The effect is the same as that of Embodiments 1 to 5.

INDUSTRIAL APPLICABILITY

As mentioned above, the valve timing adjusting device according to the present invention is suitable for preventing the lock pin from being accidentally released from the engaging cavity and for preventing the slapping sound from being caused, by use of a simple configuration.

The invention claimed is:

1. A valve timing adjusting device comprising:

a first rotor that integrally fixes: a housing having the bearing of a camshaft; a case internally having a plurality of shoes projecting therefrom and having hydraulic chambers formed between the shoes; and a cover covering the hydraulic chambers, and that rotates integrally with a crankshaft;

a second rotor that has a plurality of vanes each dividing the hydraulic chamber into an advanced-angle hydraulic chamber and a retarded-angle hydraulic chamber, can relatively rotate through a predetermined angle within the first rotor, and is integrally fixed with an intake or exhaust camshaft;

an engaging cavity provided in one of the first rotor and the second rotor; and a lock pin that is housed in a housing hole provided in the other of the first rotor and the second rotor, and that is projected therefrom by the energizing force of an energizing means, thereby abutting on the wall of the engaging cavity from an oblique direction to give a relative rotating force to the first rotor and the second rotor, wherein the housing hole of the lock pin is formed in the inner peripheral surface of the shoe of the first rotor that is opposite to the outer peripheral surface of the second rotor at an angle with the radial direction, and further wherein a work-guide surface intersected by the axis of the housing hole is provided in the surface in which the housing hole is to be machined, in the inner peripheral surface of the shoe of the first rotor opposite to the outer peripheral surface of the second rotor.

2. A valve timing adjusting device according to claim 1, wherein the tip of the lock pin abutting on the wall of the engaging cavity from an oblique direction is tapered such that the tip thereof is parallel to the wall of the engaging cavity.

3. A valve timing adjusting device according to claim 1, wherein the engaging cavity is given the shape of a groove.

4. A valve timing adjusting device according to claim 1, wherein the engaging cavity the wall of which abuts on the tip of the lock pin traveling parallel to the rotation axis from an oblique direction is created.

* * * * *